US011421942B2

(12) United States Patent
Kume et al.

(10) Patent No.: US 11,421,942 B2
(45) Date of Patent: Aug. 23, 2022

(54) VAPOR CHAMBER

(71) Applicant: Murata Manufacturing Co., Ltd., Nagaokakyo (JP)

(72) Inventors: Norikazu Kume, Nagaokakyo (JP); Takuo Wakaoka, Nagaokakyo (JP)

(73) Assignee: MURATA MANUFACTURING CO., LTD., Nagaokakyo (JP)

( * ) Notice: Subject to any disclaimer, the term of this patent is extended or adjusted under 35 U.S.C. 154(b) by 33 days.

(21) Appl. No.: 16/535,662

(22) Filed: Aug. 8, 2019

(65) Prior Publication Data

US 2020/0003499 A1 Jan. 2, 2020

Related U.S. Application Data

(63) Continuation of application No. PCT/JP2018/036006, filed on Sep. 27, 2018.

(30) Foreign Application Priority Data

Sep. 29, 2017 (JP) ..... JP2017-190730

(51) Int. Cl.

| | |
|---|---|
| ***F28D 15/02*** | (2006.01) |
| ***F28D 15/04*** | (2006.01) |
| ***H01L 23/427*** | (2006.01) |
| ***H05K 7/20*** | (2006.01) |
| ***F28F 21/08*** | (2006.01) |

(52) U.S. Cl.

CPC ..... *F28D 15/046* (2013.01); *F28D 15/0233* (2013.01); *F28F 21/081* (2013.01); *F28F 2255/02* (2013.01)

(58) Field of Classification Search

CPC .. B23P 2700/09; F28D 15/02; F28D 15/0233; F28D 15/04; F28D 15/046; F28D 15/0241; H01L 23/427; H05K 7/20336

USPC ..... 165/104.26

See application file for complete search history.

(56) References Cited

U.S. PATENT DOCUMENTS

| | | | | |
|---|---|---|---|---|
| 6,269,866 | B1 * | 8/2001 | Yamamoto | F28D 15/0233 165/104.26 |
| 8,534,348 | B2 | 9/2013 | Ohsawa | |
| 8,757,247 | B2 * | 6/2014 | Yang | F28D 15/046 165/104.21 |

(Continued)

FOREIGN PATENT DOCUMENTS

| | | |
|---|---|---|
| CN | 101639331 A | 2/2010 |
| CN | 101738114 A | 6/2010 |

(Continued)

OTHER PUBLICATIONS

International Search Report issued in PCT/JP2018/036006, dated Dec. 11, 2018.

(Continued)

*Primary Examiner* — Frantz F Jules
*Assistant Examiner* — Jason N Thompson
(74) *Attorney, Agent, or Firm* — ArentFox Schiff LLP

(57) ABSTRACT

A vapor chamber that includes a housing defining an internal space, and a working medium and a wick structure in the internal space of the housing. As viewed in a plan view, the vapor chamber has a first region with a first thickness and a second region with a second thickness, the second thickness being smaller than the first thickness.

11 Claims, 9 Drawing Sheets

(56) References Cited

U.S. PATENT DOCUMENTS

2002/0189793 A1* 12/2002 Noda ..... F28D 15/046 165/104.26
2004/0011512 A1 1/2004 Noda et al.
2007/0056711 A1 3/2007 Ohsawa
2007/0294892 A1* 12/2007 Yang ..... F28D 15/046 29/890.032
2008/0073062 A1* 3/2008 Schuette ..... H01L 23/427 165/80.4
2008/0135214 A1 6/2008 Ohsawa et al.
2008/0216994 A1* 9/2008 Lee ..... H01L 23/427 165/104.26
2009/0040726 A1* 2/2009 Hoffman ..... F28D 15/0233 361/700
2010/0071879 A1* 3/2010 Hou ..... F28D 15/046 165/104.26
2010/0126701 A1 5/2010 Hou
2011/0232877 A1* 9/2011 Meyer, IV ..... F28D 15/0266 165/104.26
2011/0315351 A1* 12/2011 Meyer, IV ..... F28D 15/0233 165/104.26
2012/0186784 A1* 7/2012 Yang ..... F28D 15/0266 165/104.21
2013/0025829 A1 1/2013 Huang
2014/0166244 A1* 6/2014 Dai ..... F28D 15/0233 165/104.26
2014/0345832 A1* 11/2014 Lin ..... F28D 15/046 165/104.26
2017/0023308 A1* 1/2017 Huang ..... F28D 15/0233
2018/0010861 A1 1/2018 Wakaoka et al.
2018/0288901 A1* 10/2018 Huang ..... H01L 23/3672
2019/0141855 A1* 5/2019 Inagaki ..... H01L 23/427

FOREIGN PATENT DOCUMENTS

CN 201964812 U 9/2011
CN 103021975 A 4/2013
JP S54108050 A 8/1979
JP 3050180 U 6/1998
JP 2001074381 A 3/2001
JP 2001091172 A 4/2001
JP 2004037001 A 2/2004
JP 2007315745 A 12/2007
WO 2016151916 A1 9/2016
WO 2018003957 A1 1/2018

OTHER PUBLICATIONS

Written Opinion of the International Searching Authority issued in PCT/JP2018/036006, dated Dec. 11, 2018.

* cited by examiner

FIG. 16 – PRIOR ART

FIG. 17 – PRIOR ART
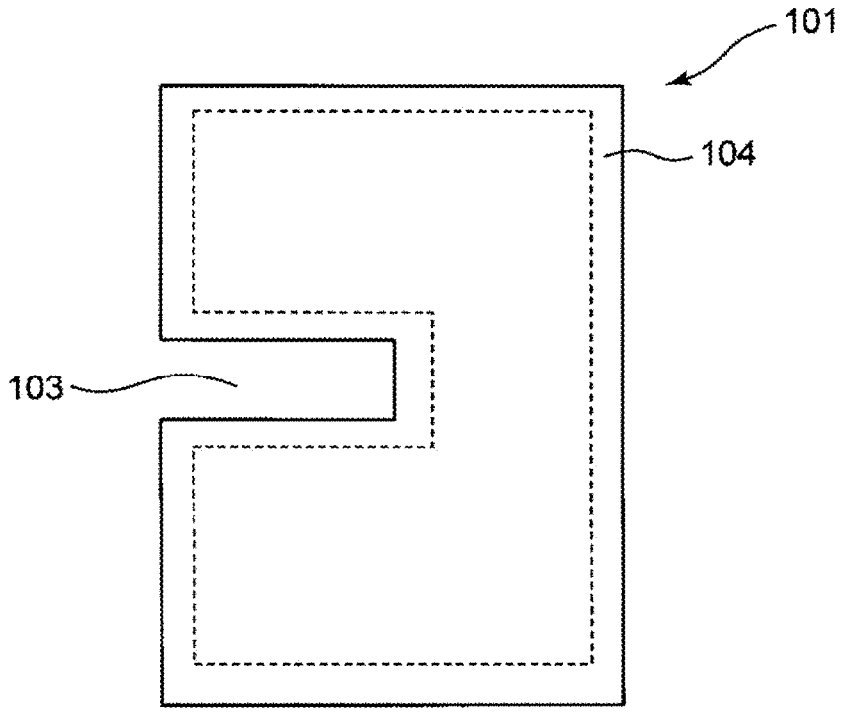

VAPOR CHAMBER

CROSS REFERENCE TO RELATED APPLICATIONS

The present application is a continuation of International application No. PCT/JP2018/036006, filed Sep. 27, 2018, which claims priority to Japanese Patent Application No. 2017-190730, filed Sep. 29, 2017, the entire contents of each of which are incorporated herein by reference.

FIELD OF THE INVENTION

The present invention relates to a vapor chamber.

BACKGROUND OF THE INVENTION

In recent years, devices have been subjected to higher degree of integration and upgrading for high performance, which results in an increase in heat emission. On the other hand, products have become smaller in size, which causes heat generation density to increase. Dissipating heat has become an important issue. This situation is found especially in the field of mobile terminals, such as smartphones and tablet devices. In recent years, a graphite sheet or the like has been often adopted as a heat dissipating member. However, the heat transport capacity of the graphite sheet is not large enough. Accordingly, application of various other heat dissipating members has been studied. In particular, use of a vapor chamber, which is a tabularly shaped heat pipe that can transport heat very efficiently, has been progressively studied.

The vapor chamber has a structure that includes a housing within which a working medium and a wick structure are disposed. The wick structure transports the working medium by using capillary forces. The working medium absorbs heat at an evaporation section of the vapor chamber that receives heat from a device that generates the heat. The working medium evaporates in the vapor chamber and moves to a condensation section where the working medium is cooled and returns to a liquid phase. The working medium after returning to the liquid phase moves toward the device that generates heat (i.e., toward the evaporation section) due to the capillary forces of the wick structure and cools the device. By repeating this process self-supportedly without using external power, the vapor chamber can quickly dissipate heat two-dimensionally by utilizing the latent heat of vaporization and condensation of the working medium.

A known vapor chamber of this type, for example, includes a sheet-like container, a wick structure enclosed in the container, and a working medium enclosed in the container (see Patent Document 1).

Patent Document 1: International Publication No. 2016/151916

SUMMARY OF THE INVENTION

Such a vapor chamber can be incorporated in various types of electronic devices. In an electronic device, other components may be disposed around the vapor chamber. When other components are present around the vapor chamber, a vapor chamber 101 may need to have a through hole 102 or a notch 103 formed therein so as to avoid interference with the components (see FIGS. 16 and 17). However, if the through hole or the notch is formed in the vapor chamber, the through hole or the notch cannot perform function of vapor chamber. Moreover, the through hole or the notch requires a joint portion (sealing portion) 104 formed therearound, which decreases the internal space that can serve as a working region 105 of the vapor chamber. Accordingly, the cross section of the heat transport path in the internal space decreases, which lowers the heat transport capacity.

Thus, an object of the present invention is to provide a vapor chamber that can suppress the likelihood of interference with other components while minimizing the deterioration in the heat transport capacity of the vapor chamber when the vapor chamber is mounted in an electronic device.

As the results of intensive studies to solve the above-described problems, the inventors provide a vapor chamber having a thin portion in order to avoid interference with other components disposed around the vapor chamber to complete the invention.

According to a first aspect of the invention, a vapor chamber includes a housing defining an internal space, and a working medium and a wick structure in the internal space of the housing. As viewed in a plan view, the vapor chamber has a first region with a first thickness and a second region with a second thickness, the second thickness being smaller than the first thickness.

According to a second aspect of the invention, a heat radiation device includes the vapor chamber of the present invention.

According to a third aspect of the invention, an electronic device includes the vapor chamber of the present invention or the heat radiation device of the present invention.

According to the present invention, by reducing the thickness of a portion of the vapor chamber, the interference with other components around the vapor chamber can be avoided while the deterioration in the heat transport capacity of the vapor chamber is minimized.

BRIEF DESCRIPTION OF THE DRAWINGS

FIG. 16 is a plan view illustrating an example of a known vapor chamber.

FIG. 17 is a plan view illustrating another example of a known vapor chamber.

DETAILED DESCRIPTION OF THE PREFERRED EMBODIMENTS

The following describes a vapor chamber according to the present invention in detail.

First Embodiment

Figure 1:
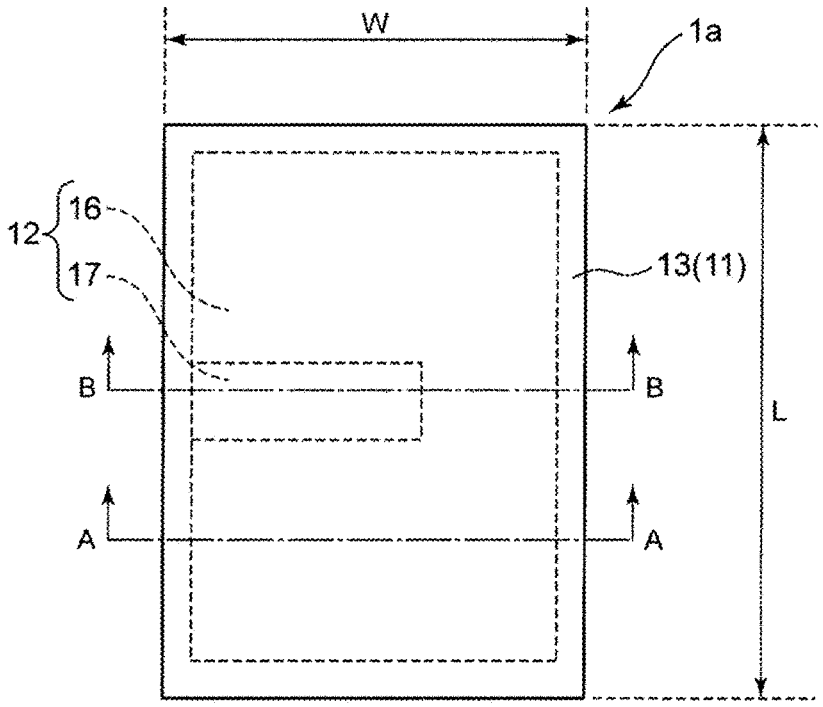
FIG. 1 is a plan view illustrating a vapor chamber la according to an embodiment of the present invention.
Figure 2:
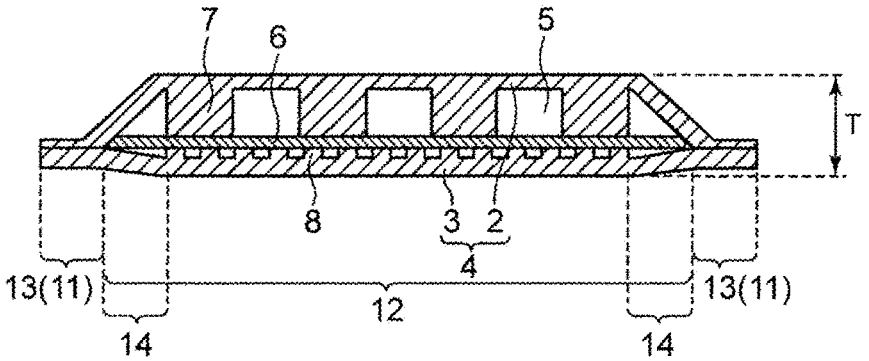
FIG. 2 is a cross section of the vapor chamber 1*a* taken along line A-A of FIG. 1.

FIG. 1 is a plan view of a vapor chamber 1*a* according to an embodiment, which will be described below. FIG. 2 is a cross section taken along line A-A of FIG. 1, and FIG. 3 is also a cross section taken along line B-B of FIG. 1.

Figure 3:
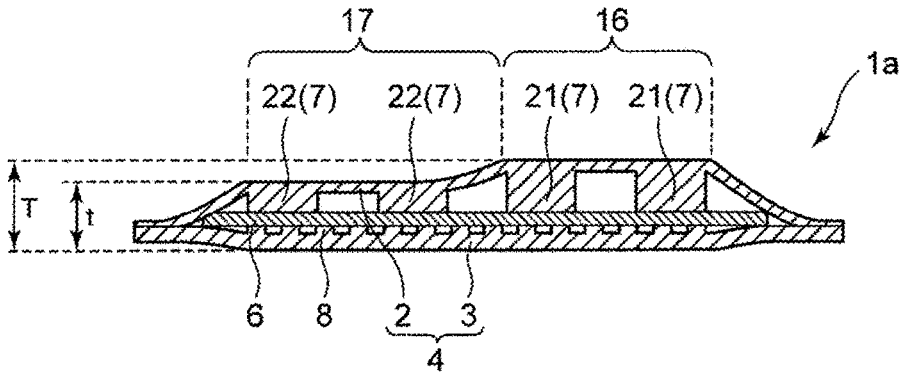
FIG. 3 is a cross section of the vapor chamber 1*a* taken along line B-B of FIG. 1.

As illustrated in FIGS. 1 to 3, the vapor chamber 1*a* includes a housing 4 constituted by a first sheet 2 and a second sheet 3. The first sheet 2 and the second sheet 3 oppose each other and have respective peripheral portions joined to each other. A wick structure 6 is disposed in an internal space 5 formed inside the housing 4. To form the internal space 5 in the housing 4, first pillars 7 are disposed between the first sheet 2 and the wick structure 6 so as to support the first sheet 2 and the second sheet 3 from inside. Second pillars 8 are disposed between the second sheet 3 and the wick structure 6. The first sheet 2 and the second sheet 3 approach each other in an outer region that surrounds a region where the first pillars 7 are disposed. The first sheet 2 and the second sheet 3 are in contact with each other at the peripheral portion and are joined and sealed there. The portion at which the first sheet 2 and the second sheet 3 are joined is also referred to as a "joint portion". In other words, the first sheet 2 and the second sheet 3 typically start to approach each other from respective ends of the first pillars 7 that are located closest to an edge of the sheets. The first sheet 2 and the second sheet 3 are joined and sealed at a joint portion 11 located at the peripheral portion of the sheets. In addition, the vapor chamber la contains a working medium (not illustrated) that is enclosed in the internal space 5 of the housing 4.

As illustrated in FIGS. 1 and 2, the vapor chamber la has a working region 12 and a secondary working region 13 as viewed in a plan view. The working region 12 is formed of the internal space 5 in which the working medium is enclosed, and the secondary working region 13 is formed so as to surround the working region 12. The secondary working region 13 generally corresponds to the joint portion 11 at which the first sheet 2 and the second sheet 3 are joined. The working region 12 functions as a vapor chamber and accordingly has a very high heat transport capacity. Accordingly, the working region is preferably formed as widely as possible. On the other hand, the secondary working region 13 is not a region functioning as a vapor chamber. However, the secondary working region 13 is also formed of a material having a high thermal conductivity and has a heat transport capacity to some extent. In addition, the secondary working region 13 is shaped like a sheet not having the internal space 5 and thus superior in durability, flexibility, and processability. The secondary working region 13 can be utilized as an attaching region when the vapor chamber is attached to an electronic device.

As illustrated in FIGS. 1 and 3, the working region 12 includes a first region 16 having a thickness T and a second region 17 having a thickness t. The thickness T is greater than the thickness t (T>t). In other words, the working region 12 includes the first region 16 that is relatively thick and the second region 17 that is thinner than the first region 16. Note that the vapor chamber also has a small thickness portion at a position immediately inside the joint portion 11 where the first sheet 2 and the second sheet 3 approach each other for joining. However, this thin portion for joining does not constitute the second region 17. In the vapor chamber 1*a*, the difference between the thickness T of the first region 16 and the thickness t of the second region 17 can be made by changing the height of the first pillars 7 located in respective regions. In other words, in the vapor chamber 1*a*, the height of the first pillars 22 in the second region 17 is smaller than the height of the first pillars 21 in the first region 16.

Due to the second region having a smaller thickness as described above, the vapor chamber according to the present invention can be mounted in an electronic device while avoiding interference with other components being present around the vapor chamber to be mounted. In the second region 17, the first sheet 2 and the second sheet 3 are not joined, in other words, not in close and tight contact with each other although some portions may be in contact. Here, "close and tight contact" means a contact state in which the working medium enclosed in the vapor chamber in the second region 17 cannot enter the contact portion whether the working medium is in a liquid phase or in a gas phase. The second region 17 may have a heat transport capacity smaller than that of the first region 16 but does not totally lose the heat transport capacity. Thus, the vapor chamber according to the present invention includes the second region having a smaller thickness. This can suppress the likelihood of the vapor chamber interfering with other components being present around the vapor chamber when the vapor chamber is mounted in an electronic device and also can minimize deterioration in the heat transport capacity of the vapor chamber.

The vapor chamber 1*a* is generally formed into a tabular shape. In other words, the housing 4 generally has a tabular shape. Here, the "tabular shape" may include a shape like a panel or a shape like a sheet, which is a shape having the length and the width substantially greater than the height (thickness), for example, 10 or more times greater than the thickness, or preferably 100 or more times greater than the thickness.

The size of the vapor chamber 1*a*, in other words, the size of the housing 4, is not specifically limited here. The length (indicated by L in FIG. 1) and the width (indicated by W in FIG. 1) of the vapor chamber 1*a* may be set appropriately in accordance with application purposes. For example, they may be 5 mm or more and 500 mm or less, 20 mm or more and 300 mm or less, or 50 mm or more and 200 mm or less.

The thickness T of the vapor chamber la in the first region 16 is not specifically limited, either, but may be preferably 100 μm or more and 600 μm or less, more preferably 200 μm or more and 500 μm or less.

The thickness t of the vapor chamber la in the second region 17 is not specifically limited insofar as it is smaller than the thickness T but may be preferably 500 μm or less, more preferably 300 μm or less, even more preferably 200 μm or less, still even more preferably 100 μm or less. For example, the thickness t may be 50 μm or more and 500 μm or less, or alternatively, 100 μm or more and 300 μm or less. The smaller the thickness t, the less interference with other components. The greater the thickness t, the more the heat transport of the vapor chamber 1*a*.

The difference between the thickness T and the thickness t may be preferably 10 μm or more, more preferably 50 μm or more, even more preferably 100 μm or more. For example, the difference may be 200 μm or more or may be 300 μm or more. For example, the difference between the thickness T and the thickness t may be 10 μm or more and 500 μm or less, or alternatively, 100 μm or more and 300 μm or less.

The ratio of the thickness t to the thickness T (t/T) is not specifically limited here but may be preferably 0.95 or less, more preferably 0.80 or less, even more preferably 0.60 or less. For example, the ratio may be 0.50 or less, 0.30 or less, or 0.20 or less. For example, the ratio of the thickness t to the thickness T may be 0.10 or more and 0.95 or less, 0.20 or more and 0.80 or less, or alternatively, 0.30 or more and 0.50 or less.

The materials of the first sheet 2 and the second sheet 3 are not specifically limited here insofar as they have characteristics appropriate for the vapor chamber, for example, thermal conductivity, strength, elasticity, and flexibility. The materials of the first sheet 2 and the second sheet 3 may be preferably a metal, for example, copper, nickel, aluminum, magnesium, titan, iron, or alloys thereof. The material may be more preferably copper. The first sheet 2 and the second sheet 3 may be formed of the same material or of different materials. However, the first sheet 2 and the second sheet 3 may preferably be formed of the same material.

The thickness of the first sheet 2 and the thickness of the second sheet 3 are not specifically limited here but may be preferably 10 μm or more and 200 μm or less, more preferably 30 μm or more and 100 μm or less. For example, the thickness may be 40 μm or more and 60 μm or less. The first sheet 2 and the second sheet 3 may have the same thickness or may have different thicknesses. Each of the first sheet 2 and the second sheet 3 may have a uniform thickness or may have a thinner portion. In the present embodiment, the first sheet 2 and the second sheet 3 may preferably have the same thickness. Moreover, each of the first sheet 2 and the second sheet 3 may preferably have a uniform thickness.

The first sheet 2 and the second sheet 3 are joined to each other at the peripheral portion thereof. The joining method is not specifically limited here but may be, for example, laser welding, resistance welding, diffusion bonding, soldering, TIG arc welding (tungsten inert-gas arc welding), ultrasonic bonding, and plastic molding. Laser welding, resistance welding, and soldering may be preferably used for joining.

First pillars 7 are disposed between the first sheet 2 and the second sheet 3. A plurality of the first pillars 7 are disposed on a major surface of the first sheet 2 that faces the internal space 5. The first pillars 7 support the first sheet 2 and the second sheet 3 from inside so as to maintain a predetermined distance therebetween. In other words, the first pillars 7 function as columns to support the first sheet 2 and the second sheet 3 of the vapor chamber. By disposing the first pillars 7 inside the housing 4, deformation of the housing can be suppressed in such a case that the inside of the housing is depressurized or an external pressure is applied to the housing from outside.

Second pillars 8 are disposed between the first sheet 2 and the second sheet 3. A plurality of the second pillars 8 are disposed on a major surface of the second sheet 3 that faces the internal space 5. By disposing a plurality of the second pillars, a working medium can be retained between the second pillars, which makes it easier to hold an increased amount of the working medium in the vapor chamber of the present invention. Increasing the amount of the working medium improves the heat transport capacity of the vapor chamber. Here, "second pillars" refers to relatively high portions raised from the nearby surface, which may include portions that protrude from the major surface. In addition to pillars or the like protruding from the major surface, the second pillars may include relatively high portions that are formed, for example, by recesses such as grooves in the major surface.

The height of the first pillars 7 are greater than the height of the second pillars 8. In an embodiment, the height of the first pillars 7 may be preferably 1.5 times or more and 100 times or less of the height of the second pillars 8. More preferably, with respect to the height of the second pillars 8, the height of the first pillars 7 may be 2 times or more and 50 times or less, even more preferably 3 times or more and 20 times or less, still even more preferably 3 times or more and 10 times or less.

The shape of each of the first pillars 7 is not specifically limited here insofar as the first sheet 2 and the second sheet 3 can be supported. However, each first pillar 7 may be preferably formed into a columnar shape, for example, a circular column, a rectangular column, a truncated cone, or a truncated pyramid.

The material of the first pillars 7 is not specifically limited here but may be, for example, a metal, such as copper, nickel, aluminum, magnesium, titan, iron, or alloys thereof. The material may be preferably copper. In some preferred embodiments, the material of the first pillars 7 may be the same as one or both of the materials of the first sheet 2 and the second sheet 3.

The height of the first pillars 7 may be set appropriately in accordance with the thickness of a desired vapor chamber. The height may be preferably 50 μm or more and 500 μm or less, more preferably 100 μm or more and 400 μm or less, even more preferably 100 μm or more and 200 μm or less. For example, the height may be 125 μm or more and 150 μm or less. Here, the height of the first pillars is the height measured in the thickness direction of the vapor chamber. Note that as described above, in the vapor chamber 1*a*, the height of the first pillars 22 (7) in the second region 17 is smaller than the height of the first pillars 21 (7) in the first region 16. In other words, in the vapor chamber 1*a*, the height of the first pillars is not uniform but may vary according to requirements of a location where the vapor chamber la is installed.

The thickness of each of the first pillars 7 is not specifically limited insofar as it provides a strength enough to suppress deformation of the housing of the vapor chamber. However, a circle equivalent diameter of a section of each first pillar 7 taken perpendicular to the vertical direction may be, for example, 100 μm or more and 2000 μm or less, preferably 300 μm or more and 1000 μm or less. Increasing the circle equivalent diameter of the first pillar can better suppress the deformation of the housing of the vapor chamber. On the other hand, decreasing the circle equivalent diameter of the first pillar can provide a larger space in which the vapor of the working medium moves.

The pattern of arranging the first pillars 7 is not specifically limited but may be preferably an equidistant arrangement, in other words, a grid-like pattern in which, for example, first pillars 7 are disposed on equidistant grid points. The equidistant arrangement of the first pillars provides a uniform strength over the entire vapor chamber.

The number of the first pillars 7 and the distance therebetween in this arrangement are not specifically limited here. However, the number of the first pillars 7 per 1 $mm^2$ of major surface area of one of the sheets defining the internal space of the vapor chamber may be preferably 0.125 pillars or more and 0.5 pillars or less, more preferably 0.2 pillars or more and 0.3 pillars or less. Increasing the number of the first pillars can better suppress deformation of the vapor chamber (or the housing). On the other hand, decreasing the number of the first pillars can provide a larger space in which the vapor of the working medium moves.

The first pillars 7 may be formed integrally with the first sheet 2. Alternatively, the first pillars 7 may be formed separately and thereafter fixed to the first sheet 2 at predetermined positions.

The height of each of the second pillars 8 is not specifically limited here but may be preferably 1 μm or more and 100 μm or less, more preferably 5 μm or more and 50 μm or less, and even more preferably 15 μm or more and 30 μm or less. Increasing the height of each second pillar can increase the amount of the working medium retained therein. On the other hand, decreasing the height of each second pillar can provide a larger space in which the vapor of the working medium moves (i.e., a larger space on the side of the first pillars). Accordingly, adjusting the height of the second pillars can adjust the heat transport capacity of the vapor chamber.

The distance between adjacent second pillars 8 is not specifically limited but may be preferably 1 μm or more and 500 μm or less, more preferably 5 μm or more and 300 μm or less, even more preferably 15 μm or more and 150 μm or less. Decreasing the distance between adjacent second pillars can increase capillary forces. Increasing the distance between adjacent second pillars can improve permeability.

The shape of each second pillar 8 is not specifically limited here but may be formed into a circular column, a rectangular column, a truncated cone, or a truncated pyramid. Moreover, each second pillar 8 may be shaped like a wall, in other words, such a shape that a groove is formed between adjacent second pillars 8.

The second pillars 8 may be formed integrally with the second sheet 3. Alternatively, the second pillars 8 may be formed separately and thereafter fixed to the second sheet 3 at predetermined positions.

The type of the above-described wick structure 6 is not specifically limited insofar as the wick structure enables the working medium to move due to capillary forces. The capillary structure that generates capillary forces to cause the working medium to move is not specifically limited here but may be a known structure used in a known vapor chamber. For example, the above capillary structure may encompass micro structures, such as a fibrous structure, a pleated structure, or a reticular structure, which have irregularities, for example, pores, grooves, or protrusions.

The thickness of the wick structure 6 is not specifically limited here but may be, for example, 5 μm or more and 200 μm or less, preferably 10 μm or more and 80 μm or less, and more preferably 30 μm or more and 50 μm or less.

The size and the shape of the wick structure 6 is not specifically limited here. However, for example, the wick structure 6 may preferably have such a size and shape that the wick structure 6 can be disposed continuously from an evaporation section to a condensation section within the housing.

The type of working medium described above is not specifically limited insofar as it is subjected to gas-liquid phase transition in the environment inside the housing. For example, materials, such as water, an alcohol, or a chlorofluorocarbon substitute may be used. According to an embodiment, the working medium is an aqueous compound, preferably water.

The vapor chamber 1*a* according to an embodiment of the present invention has been described. As described above, in the vapor chamber 1*a* according to the present embodiment, the height of the first pillars 7 is made smaller in the second region than that in the first region, and thereby the thickness of the vapor chamber 1*a* in the second region is made smaller than the thickness in the first region. However, the present invention is not limited to this embodiment. As in embodiments described below, the thickness of the vapor chamber in the second region may be made smaller than that in the first region by changing the configuration of the vapor chamber instead of changing the configuration of the first pillars 7.

Second Embodiment

Figure 4:
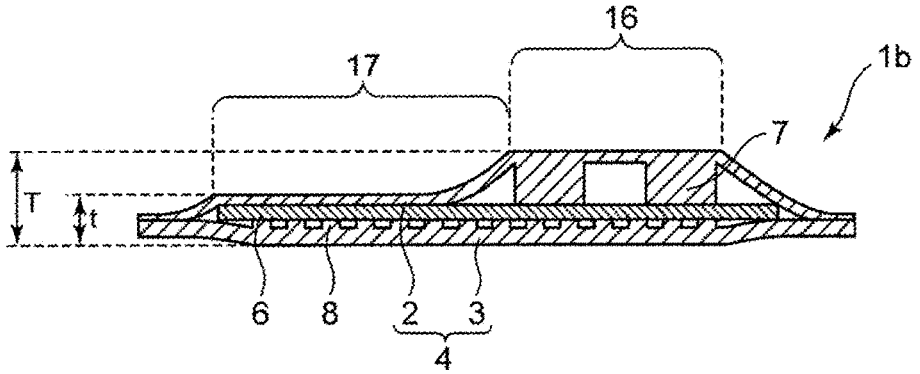
FIG. 4 is a cross section of a vapor chamber 1*b* taken along line B-B according to another embodiment.

FIG. 4 is a cross section taken along line B-B of a vapor chamber 1*b* according to the present embodiment. Note that the vapor chamber 1*b* has a structure similar to the above-described vapor chamber 1*a* except for the structure of the second region 17. In other words, the planer structure of the vapor chamber 1*b* is the same as that illustrated in FIG. 1, and the cross-sectional structure taken along line A-A is the same as that illustrated in FIG. 2.

As illustrated in FIG. 4, the vapor chamber 1*b* according to the present embodiment does not include the first pillars 7 in the second region 17. In other words, in the second region 17, the vapor chamber 1*b* includes the second sheet 3, the second pillars 8, the wick structure 6, and the first sheet 2 in order from the second sheet 3 (from the bottom side in the figure) upward. Accordingly, the wick structure 6 and the first sheet 2 are in contact with each other. According to the present embodiment, the thickness of the second region can be reduced to the extent of the height of the first pillars 7. In other words, T minus t or the difference between T and t corresponds to the height of the first pillars 7. The internal space in the second region 17 substantially does not include an upper space (a space between the wick structure 6 and the first sheet 2) that serves as a passage for a vapor. However, the working medium in the liquid phase can be transported due to capillary forces through the space (channel) between the second pillars 8 and the space in the wick structure 6. Accordingly, the second region 17 can contribute to the heat transport of the vapor chamber 1*b*.

Third Embodiment

Figure 5:
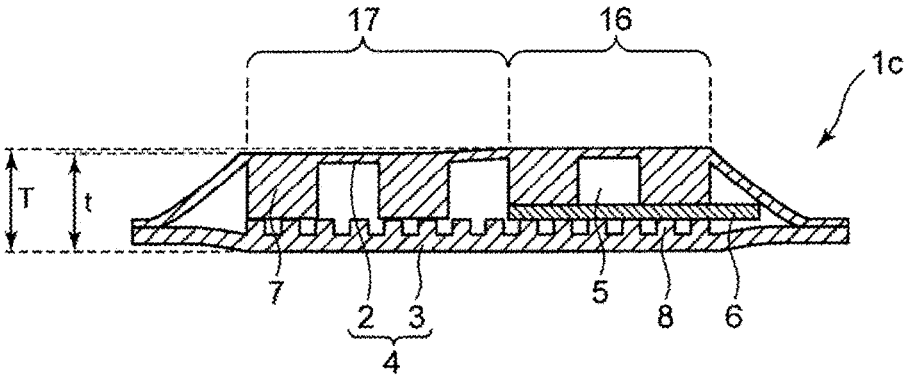
FIG. 5 is a cross section of a vapor chamber 1*c* taken along line B-B according to another embodiment.

FIG. 5 is a cross section taken along line B-B of a vapor chamber 1*c* according to the present embodiment. Note that the vapor chamber 1*c* has a structure similar to the above-described vapor chamber 1*a* except for the structure of the second region 17. In other words, the planer structure of the vapor chamber 1*c* is the same as that illustrated in FIG. 1, and the cross-sectional structure taken along line A-A is the same as that illustrated in FIG. 2.

As illustrated in FIG. 5, the vapor chamber 1*c* according to the present embodiment does not include the wick structure 6 in the second region 17 between the first pillars 7 and the second sheet 3. In other words, in the second region 17, the vapor chamber 1*c* includes the second sheet 3, the second pillars 8, the first pillars 7, and the first sheet 2 in order from the second sheet 3 (from the bottom side in the figure) upward. Accordingly, the first pillars 7 are in contact with the second pillars 8. According to the present embodiment, the thickness of the second region can be reduced to the extent of the height of the wick structure 6. In other words, T minus t or the difference between T and t corresponds to the thickness of the wick structure 6. The wick structure 6 is substantially not present in the internal space in the second region 17. However, the space between the first pillars 7 serves as the passage for the vapor of the working medium, and the working medium in the liquid phase can be transported due to capillary forces through the space (channel) between the second pillars 8 as well as through the wick structure 6. Accordingly, the second region 17 can contribute to the heat transport of the vapor chamber 1*c*.

Fourth Embodiment

Figure 6:
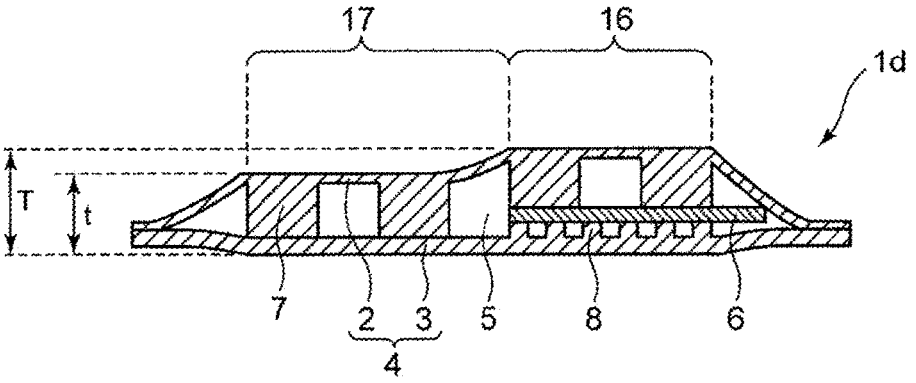
FIG. 6 is a cross section of a vapor chamber 1*d* taken along line B-B according to another embodiment.

FIG. 6 is a cross section taken along line B-B of a vapor chamber 1*d* according to the present embodiment. Note that the vapor chamber 1*d* has a structure similar to the above-described vapor chamber 1*a* except for the structure of the second region 17. In other words, the planer structure of the vapor chamber 1*d* is the same as that illustrated in FIG. 1, and the cross-sectional structure taken along line A-A is the same as that illustrated in FIG. 2.

As illustrated in FIG. 6, the vapor chamber 1*d* according to the present embodiment includes neither the wick structure 6 nor the second pillars 8 in the second region 17 between the first pillars 7 and the second sheet 3. In other words, in the second region 17, the vapor chamber 1*d* includes the second sheet 3, the first pillars 7, and the first sheet 2 in order from the second sheet 3 (from the bottom side in the figure) upward. Accordingly, the first pillars 7 and the second sheet 3 are in direct contact with each other. According to the present embodiment, the thickness of the second region can be reduced to the extent of the thickness of the wick structure 6 and the height of the second pillars 8. In other words, T minus t or the difference between T and t corresponds to the sum of the thickness of the wick structure 6 and the height of the second pillars 8. The wick structure 6 and the second pillars 8 are substantially not present in the internal space in the second region 17. However, the space between the first pillars 7 can serve as the passage for the vapor of the working medium. Accordingly, the second region 17 can contribute to the heat transport of the vapor chamber 1*d*.

Fifth Embodiment

Figure 7:
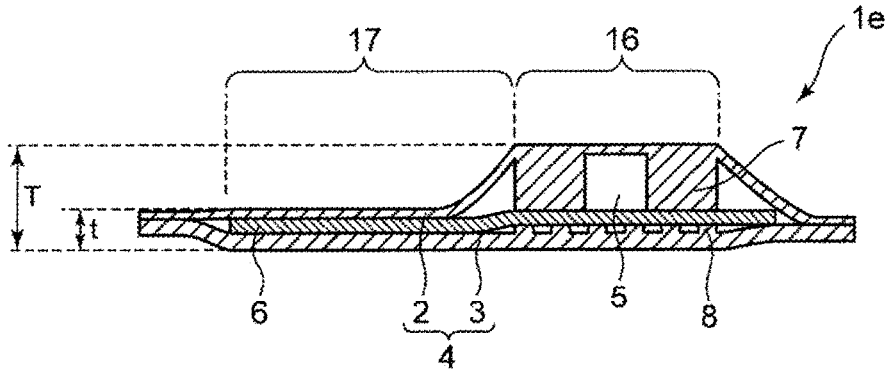
FIG. 7 is a cross section of a vapor chamber 1*e* taken along line B-B according to another embodiment.

FIG. 7 is a cross section taken along line B-B of a vapor chamber 1*e* according to the present embodiment. Note that the vapor chamber 1*e* has a structure similar to the above-described vapor chamber 1*a* except for the structure of the second region 17. In other words, the planer structure of the vapor chamber 1*e* is the same as that illustrated in FIG. 1, and the cross-sectional structure taken along line A-A is the same as that illustrated in FIG. 2.

As illustrated in FIG. 7, the vapor chamber 1*e* according to the present embodiment includes neither the first pillars 7 nor the second pillars 8 in the second region 17. In other words, in the second region 17, the vapor chamber le includes the second sheet 3, the wick structure 6, and the first sheet 2 in order from the second sheet 3 (from the bottom side in the figure) upward. Accordingly, the wick structure 6 and the first sheet 2 are in direct contact with each other, and the wick structure 6 and the second sheet 3 are also in direct contact with each other. According to the present embodiment, the thickness of the second region can be reduced to the extent of the height of the first pillars 7 and the height of the second pillars 8. In other words, T minus t or the difference between T and t corresponds to the sum of heights of the first pillars 7 and the second pillars 8. The internal space in the second region 17 substantially does not include the upper space that serves as the passage for a vapor. However, the working medium can move through the wick structure 6. Accordingly, the second region 17 can contribute to the heat transport of the vapor chamber 1*e*.

Sixth Embodiment

Figure 8:
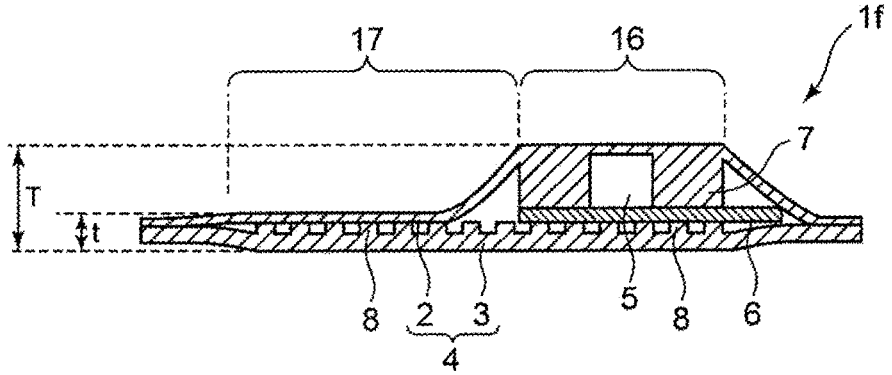
FIG. 8 is a cross section of a vapor chamber 1*f* taken along line B-B according to another embodiment.

FIG. 8 is a cross section taken along line B-B of a vapor chamber if according to the present embodiment. Note that the vapor chamber if has a structure similar to the above-described vapor chamber 1*a* except for the structure of the second region 17. In other words, the planer structure of the vapor chamber if is the same as that illustrated in FIG. 1, and the cross-sectional structure taken along line A-A is the same as that illustrated in FIG. 2.

As illustrated in FIG. 8, the vapor chamber if according to the present embodiment includes neither the first pillars 7 nor the wick structure 6 in the second region 17. In other words, in the second region 17, the vapor chamber if includes the second sheet 3, the second pillars 8, and the first sheet 2 in order from the second sheet 3 (from the bottom side in the figure) upward. Accordingly, the first sheet 2 are in direct contact with the second pillars 8. According to the present embodiment, the thickness of the second region can be reduced to the extent of the height of the first pillars 7 and the thickness of the wick structure 6. In other words, T minus t or the difference between T and t corresponds to the sum of the height of the first pillars 7 and the thickness of the wick structure 6. The wick structure 6 is substantially not present in the internal space in the second region 17. However, the working medium in the liquid phase can be transported due to capillary forces through the space (channel) between the second pillars 8 as well as through the wick structure 6. Accordingly, the second region 17 can contribute to the heat transport of the vapor chamber 1*f*.

Seventh Embodiment

Figure 9:
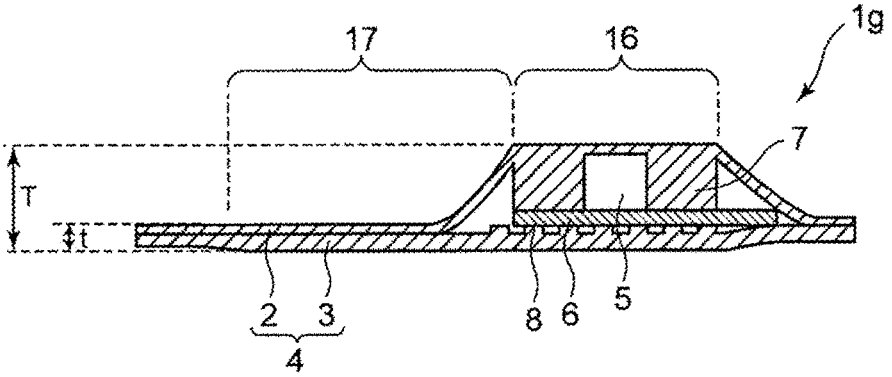
FIG. 9 is a cross section of a vapor chamber 1*g* taken along line B-B according to another embodiment.

FIG. 9 is a cross section taken along line B-B of a vapor chamber 1*g* according to the present embodiment. Note that the vapor chamber 1*g* has a structure similar to the above-described vapor chamber 1*a* except for the structure of the second region 17. In other words, the planer structure of the vapor chamber 1*g* is the same as that illustrated in FIG. 1, and the cross-sectional structure taken along line A-A is the same as that illustrated in FIG. 2.

As illustrated in FIG. 9, the vapor chamber 1*g* according to the present embodiment includes neither the first pillars 7, nor the second pillars 8, nor the wick structure 6 in the second region 17. In other words, in the second region 17, the vapor chamber 1*g* includes the second sheet 3 and the first sheet 2 in order from the second sheet 3 (from the bottom side in the figure) upward. Accordingly, the first sheet 2 and second sheet 3 are in direct contact with each other. According to the present embodiment, the thickness of the second region can be reduced to the extent of the heights of the first pillars 7 and the second pillars 8 and the thickness of the wick structure 6. In other words, T minus t or the difference between T and t corresponds to the sum of the heights of the first pillars 7 and the second pillars 8 and the thickness of the wick structure 6. Note that in the second region 17, the first sheet 2 and the second sheet 3 are in contact but are not joined to each other. Accordingly, micro gaps can be formed between the first sheet 2 and the second sheet 3 in the second region 17, and the working medium in the liquid phase can be transported due to capillary forces through the micro gaps. In other words, in the second region 17, the first sheet 2 and the second sheet 3 oppose each other via micro gaps except for direct contact portions. The width of each micro gap is, for example, less than the height of the second pillars 8 or the height of the wick structure 6. Accordingly, the second region 17 can contribute to the heat transport of the vapor chamber 1*g*.

Eighth Embodiment

Figure 10:
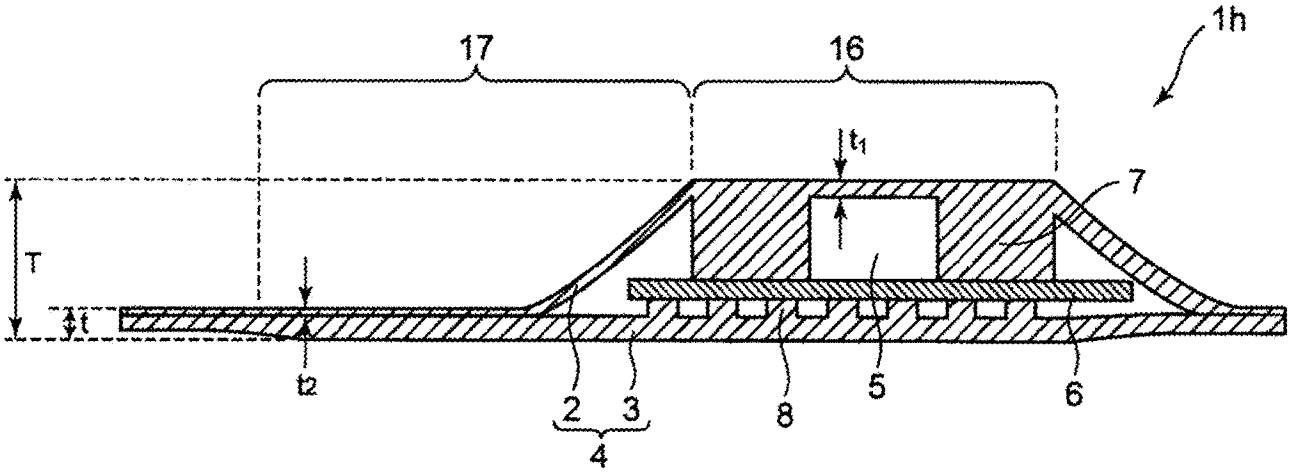
FIG. 10 is a cross section of a vapor chamber 1*h* taken along line B-B according to another embodiment.

FIG. 10 is a cross section taken along line B-B of a vapor chamber 1*h* according to the present embodiment. Note that the vapor chamber 1*h* has a structure similar to the above-described vapor chamber 1*a* except for the structure of the second region 17. In other words, the planer structure of the vapor chamber 1*h* is the same as that illustrated in FIG. 1, and the cross-sectional structure taken along line A-A is the same as that illustrated in FIG. 2.

As illustrated in FIG. 10, the vapor chamber 1*h* according to the present embodiment includes neither the first pillars 7, nor the second pillars 8, nor the wick structure 6 in the second region 17. In other words, in the second region 17, the vapor chamber 1*h* includes the second sheet 3 and the first sheet 2 in order from the second sheet 3 (from the bottom side in the figure) upward. Accordingly, the first sheet 2 and the second sheet 3 are in direct contact with each other. Moreover, the vapor chamber 1*h* is formed such that at least a portion of the first sheet 2 in the second region 17, more specifically a portion being in contact with the second sheet 3 (indicated by $t_2$ in FIG. 10), is made smaller in thickness than the other portion of the first sheet 2, more specifically a portion in the first region 16 (indicated by $t_1$ in FIG. 10). In other words, the wall thickness of the housing 4 in the second region 17 is smaller than that of the housing 4 in the first region 16. According to the present embodiment, the thickness of the second region can be reduced to the extent of the heights of the first pillars 7 and the second pillars 8, the thickness of the wick structure 6, and the difference between the thicknesses of the first sheet 2 ($t_1$-$t_2$). In other words, T minus t or the difference between T and t corresponds to the sum of the heights of the first pillars 7 and the second pillars 8, the thickness of the wick structure 6, and the decrement of the first sheet 2 ($t_1$-$t_2$). Note that in the second region 17, the first sheet 2 and the second sheet 3 are in contact but are not joined to each other. Accordingly, micro gaps can be formed between the first sheet 2 and the second sheet 3 in the second region 17, and the working medium in the liquid phase can be transported due to capillary forces through the micro gaps. In other words, in the second region 17, the first sheet 2 and the second sheet 3 oppose each other via micro gaps except for direct contact portions. The width of each micro gap is, for example, less than the height of the second pillars 8 or the height of the wick structure 6. Accordingly, the second region 17 can contribute to the heat transport of the vapor chamber 1*h*.

Ninth Embodiment

Figure 11:
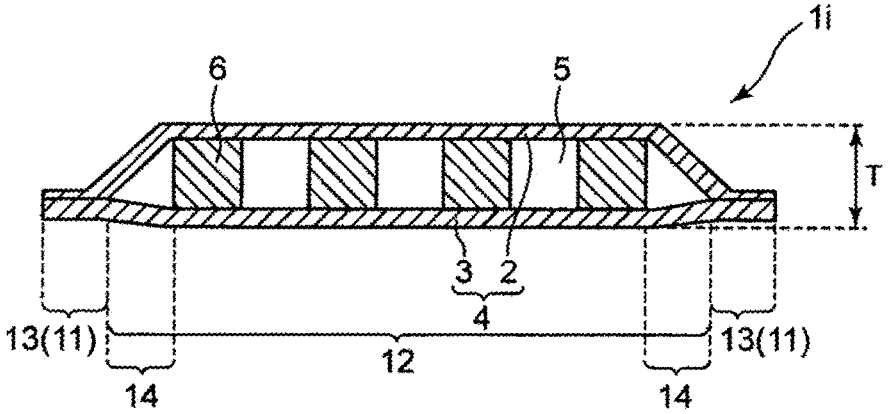
FIG. 11 is a cross section of a vapor chamber 1*i* taken along line A-A according to another embodiment.
Figure 12:
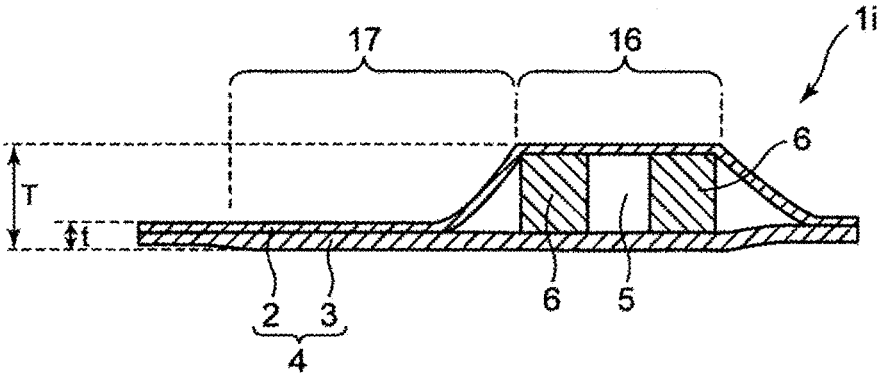
FIG. 12 is a cross section of a vapor chamber 1*i* taken along line B-B according to another embodiment.

FIG. 11 is a cross section taken along line A-A of a vapor chamber 1*i* according to the present embodiment, and FIG. 12 is a cross section taken along line B-B of the vapor chamber 1*i*. Note that the vapor chamber 1*i* has a planer structure similar to the above-described vapor chamber 1*a*. In other words, the planer structure of the vapor chamber 1*i* is the same as that illustrated in FIG. 1.

As illustrated in FIGS. 11 and 12, in the vapor chamber 1*i*, a wick structure 6 is disposed in the internal space 5 of the housing 4. The wick structure 6 is formed partially so as to support the first sheet 2 and the second sheet 3 from inside. The first sheet 2 and the second sheet 3 are close to each other in an outer region that surrounds a region where the wick structure 6 is disposed. The first sheet 2 and the second sheet 3 are in contact with each other at the peripheral portion and are joined and sealed there.

As illustrated in FIG. 12, the working region 12 of the vapor chamber 1*i* includes the first region 16 having a thickness T and the second region 17 having a thickness t. A wick structure 6 is disposed partially in the internal space 5 of the housing 4 in the first region 16. As a result, a larger space can be provided in the first region 16 in which the vapor of the working medium moves. In the second region, the first sheet 2 and the second sheet 3 are close to each other and are in contact with each other in some portions. However, the first sheet 2 and the second sheet 3 are not joined to each other. Accordingly, micro gaps can be formed between the first sheet 2 and the second sheet 3 in the second region 17, and the working medium in the liquid phase can be transported due to capillary forces through the micro gaps. In other words, in the second region 17, the first sheet 2 and the second sheet 3 oppose each other via micro gaps except for direct contact portions. The width of each micro gap is, for example, less than the thickness of the housing 4. Accordingly, the second region 17 can contribute to the heat transport of the vapor chamber 1*i*.

The vapor chamber according to the present invention has been described through several embodiments. The vapor chamber according to the present invention includes a portion of which the thickness is reduced. Accordingly, when the vapor chamber is mounted on an electronic device or the like, the thickness-reducing portion can suppress the likelihood of the vapor chamber interfering with other components being present around the vapor chamber while the deterioration in the heat transport capacity of the vapor chamber is minimized. In a known vapor chamber, a through hole or a notch has been formed so as to avoid interference with other components. On the other hand, the vapor chamber according to the present invention can avoid interference with other components without changing its original shape such as a rectangle. This can reduce the likelihood of deterioration of mechanical strength or the likelihood of deformation or warping, which otherwise may occur to the vapor chamber when a notch or the like is formed. In addition, in the vapor chamber according to the present invention, the joint and sealing portion can be made into a simple shape, which leads to easy manufacturing of the vapor chamber and also leads to improvement in reliability.

Note that the present invention is not limited to the configurations of the above-described vapor chambers but may be subject to design change to the extent without departing from the gist of the invention.

For example, the planar shape of the vapor chamber according to the present invention (i.e., the planar shape of the housing 4) is a rectangle in the above embodiments. However, the planar shape is not limited to this shape. For example, the planar shape of the vapor chamber may be a polygon such as a triangle and a rectangle, a circle, an oval, or combinations thereof. In a preferred embodiment, the planar shape of the vapor chamber according to the present invention is a rectangle. The vapor chamber according to the present invention has the rectangular planar shape, which enables the vapor chamber to maintain a high mechanical strength and reduce overall deformation and warping. It also contributes to easy manufacturing of the vapor chamber.

In the above embodiments, as illustrated in FIG. 1, a single rectangular second region 17 is formed from an edge of the working region 12 of the vapor chamber toward the center of the working region 12. However, the second region 17 is not limited to this configuration.

Figure 14:
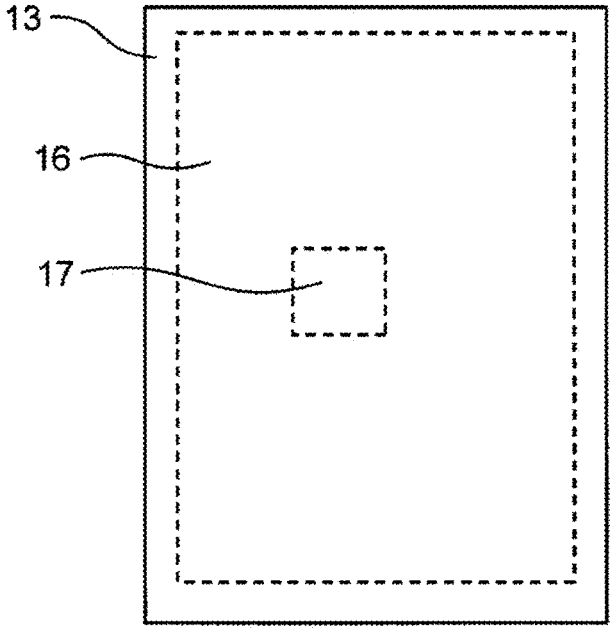
FIG. 14 is a plan view illustrating an exemplary formation of a second region.

In an embodiment, the second region 17 may be formed so as to be surrounded by the first region 16 as illustrated in FIG. 14.

Figure 15:
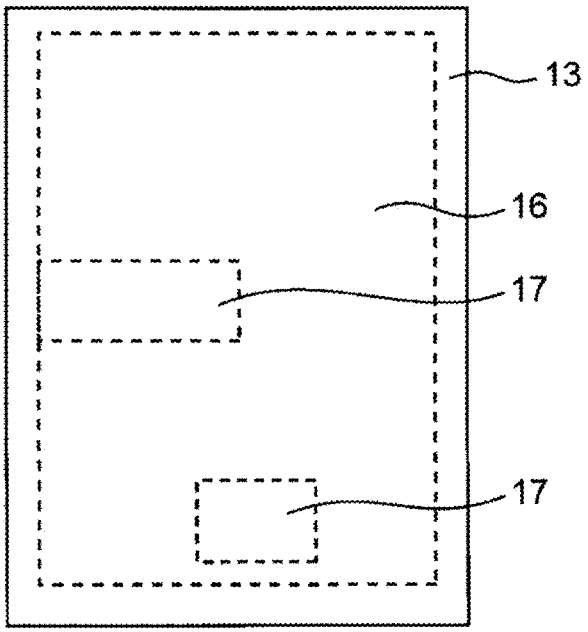
FIG. 15 is a plan view illustrating an exemplary formation of second regions.
Figure 15:
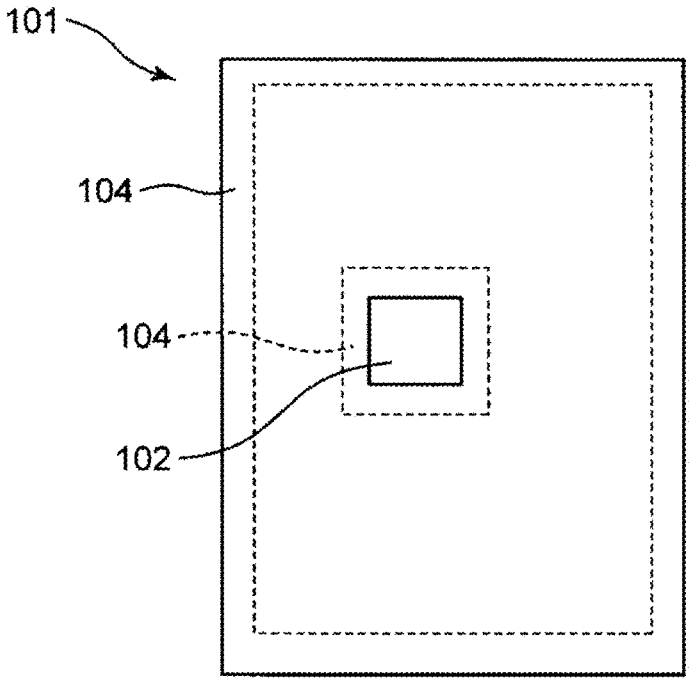

In another embodiment, a plurality of the second regions 17, for example, two, three, four, or more of the second regions 17, may be formed. For example, as illustrated in FIG. 15, the second region 17 may include two regions: one rectangularly shaped region formed from an edge of the working region 12 toward the center thereof and the other region formed so as to be surrounded by the first region 16.

Moreover, the second region 17 may have any suitable shape, for example, a shape corresponding to a component of an electronic device on which the vapor chamber according to the invention is mounted.

The thickness of the vapor chamber in the second region is made small in various configurations of the above embodiments. These configurations may be combined in any suitable manner insofar as they can be combined.

For example, in an embodiment, the first embodiment (FIG. 3: the height of the first pillars in the second region is made small) may be combined with the fourth embodiment (FIG. 6: only the first pillars are disposed in the second region). In this case, the difference between the thicknesses of the first region and the second region (T−t) becomes substantially equal to the sum of the thickness of the wick structure, the height of the second pillars, and the height difference between the first pillars in the first region and the first pillars in the second region.

In another embodiment, the fourth embodiment (FIG. 6: only the first pillars are disposed in the second region) may be combined with the fifth embodiment (FIG. 7: only the wick structure is disposed in the second region). As a result, only the first pillars and the wick structure are disposed in the second region. In this case, the difference between the thickness of the first region and the thickness of the second region (T-t) becomes roughly equal to the height of the second pillars.

Figure 13:
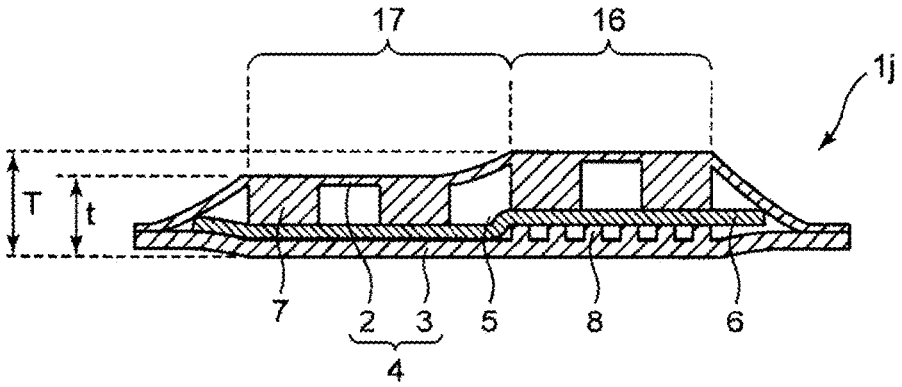
FIG. 13 is a cross section of a vapor chamber 1*j* taken along line B-B according to another embodiment.

FIG. 13 is a cross section taken along line B-B of a vapor chamber 1*j* having this configuration. Note that the vapor chamber 1*j* has a structure similar to the above-described vapor chamber 1*a* except for the structure of the second region 17. In other words, the planer structure of the vapor chamber 1*j* is the same as that illustrated in FIG. 1, and the cross-sectional structure taken along line A-A is the same as that illustrated in FIG. 2.

As illustrated in FIG. 13, the vapor chamber 1*j* according to the present embodiment does not include the second pillars 8 in the second region 17. In other words, in the second region 17, the vapor chamber 1*j* includes the second sheet 3, the wick structure 6, the first pillars 7, and the first sheet 2 in order from the second sheet 3 (from the bottom side in the figure) upward. Accordingly, the wick structure 6 is in direct contact with the first pillars 7 and also with the second sheet 3. According to the present embodiment, the thickness of the second region can be reduced to the extent of the height of the second pillars 8. In other words, T minus t or the difference between T and t corresponds to the height of the second pillars 8. The second pillars 8 are not present in the internal space in the second region 17. However, the space between the first pillars 7 can serve as the passage for the vapor of the working medium. Accordingly, the second region 17 can contribute to the heat transport of the vapor chamber 1*j*.

The vapor chamber according to the present invention can be preferably applied to electronic devices having various internal configurations.

REFERENCE SIGNS LIST

1*a* to 1*h* vapor chamber
2 first sheet
3 second sheet
4 housing
5 internal space
6 wick structure
7 first pillar
8 second pillar
11 joint portion
12 working region
13 secondary working region
16 first region
17 second region
21 first pillar
22 first pillar
101 vapor chamber
102 through hole
103 notch
104 joint portion
105 working region

The invention claimed is:

1. A vapor chamber comprising:

a housing defining an internal space;

a working medium enclosed in the internal space of the housing; and a wick structure in the internal space of the housing, wherein as viewed in a cross-sectional view of the vapor chamber, the vapor chamber has a first region with a first thickness and a second region with a second thickness, the second thickness being smaller than the first thickness, the housing includes a first sheet and a second sheet that oppose each other, the vapor chamber further includes a first pillar and a second pillar in each of the first and second regions, where a height of the first pillar in the second region is less than a height of the first pillar in the first region, and at least one of the first pillars are on a first major surface of the wick structure, and at least one of the second pillars are on a second major surface of the wick structure opposite the first major surface.

2. The vapor chamber according to claim 1, wherein a difference between the first thickness and the second thickness is 10 μm to 500 μm.

3. The vapor chamber according to claim 1, wherein a ratio of the second thickness to the first thickness is 0.10 to 0.95.

4. The vapor chamber according to claim 1, wherein at least one of the first pillar, the second pillar, and the wick structure is configured differently in the first region and the second region.

5. The vapor chamber according to claim 1, wherein the wick structure is disposed only in the first region.

6. The vapor chamber according to claim 1, wherein a first wall thickness of the housing in the second region is smaller than a second wall thickness of the housing in the first region.

7. The vapor chamber according to claim 1, wherein the housing has a rectangular shape as viewed in the plan view.

8. The vapor chamber according to claim 1, wherein the first sheet and the second sheet are in contact with each other at least in a first portion of the second region, and the first sheet and the second sheet oppose each other and define micro gaps interposed therebetween in a second portion of the second region.

9. The vapor chamber according to claim 8, wherein the micro gaps are sized such that the working medium in a liquid phase thereof can be transported due to capillary forces through the micro gaps.

10. A heat radiation device comprising the vapor chamber according to claim 1.

11. An electronic device comprising the vapor chamber according to claim 1.

* * * * *